US006174657B1

(12) United States Patent
Weidner et al.

(10) Patent No.: US 6,174,657 B1
(45) **Date of Patent: *Jan. 16, 2001**

(54) PHOTOTHERMOGRAPHIC ELEMENT HAVING DESIRED COLOR

(75) Inventors: Charles H. Weidner, Ontario; Dorothy T. Java, Fairport; Stephen A. Hershey, Victor; Elizabeth K. Priebe, Rochester, all of NY (US)

(73) Assignee: Eastman Kodak Company, Rochester, NY (US)

( * ) Notice: Under 35 U.S.C. 154(b), the term of this patent shall be extended for 0 days.

This patent is subject to a terminal disclaimer.

(21) Appl. No.: 09/103,596

(22) Filed: Jun. 24, 1998

(51) Int. Cl.[7] ..... G03C 1/498; G03C 1/83

(52) U.S. Cl. ..... 430/510; 430/517; 430/519; 430/520; 430/521; 430/523; 430/619; 430/522

(58) Field of Search ..... 430/517, 519, 430/619, 520, 617, 521, 523, 510, 522

(56) References Cited

U.S. PATENT DOCUMENTS

| | | | |
|---|---|---|---|
| 3,705,807 | 12/1972 | Bussatto . | |
| 3,846,136 | 11/1974 | Sullivan . | |
| 3,948,664 | 4/1976 | Okuyama et al. . | |
| 3,994,732 | 11/1976 | Winslow . | |
| 4,021,249 | 5/1977 | Noguchi et al. . | |
| 4,123,282 | 10/1978 | Winslow . | |
| 4,581,325 | 4/1986 | Kitchin et al. . | |
| 4,818,675 | 4/1989 | Miyasaka et al. . | |
| 4,847,149 | 7/1989 | Kiyohara et al. . | |
| 5,024,926 | 6/1991 | Itoh et al. . | |
| 5,213,951 | 5/1993 | Delfino . | |
| 5,262,286 | 11/1993 | Bacilek et al. . | |
| 5,401,620 | 3/1995 | Sasai et al. . | |
| 5,468,599 | 11/1995 | Biavasco et al. . | |
| 5,620,839 | 4/1997 | Kawamoto et al. . | |
| 5,677,121 | 10/1997 | Tsuzuki . | |
| 5,716,769 | 2/1998 | Dickerson et al. . | |
| 5,741,632 | 4/1998 | Kiekens . | |
| 5,744,294 | 4/1998 | Dickersn et al. . | |
| 5,783,380 * | 7/1998 | Smith et al. | 430/619 |

FOREIGN PATENT DOCUMENTS

| | | |
|---|---|---|
| 0 655 645 A1 | 5/1995 | (EP) . |
| 0 803 764 A1 | 10/1997 | (EP) . |
| 0 889 355 A1 | 1/1999 | (EP) . |
| 0 919 864 A1 | 6/1999 | (EP) . |

OTHER PUBLICATIONS

US Application Serial No. 08/979,317, filed Nov. 26, 1997, by Weidner et al.
US Application Serial No. 09/156,686, filed Sep. 18, 1998, by Weidner et al.

* cited by examiner

*Primary Examiner*—Thorl Chea
(74) *Attorney, Agent, or Firm*—Edith A. Rice

(57) ABSTRACT

A photothermographic element comprises: (a) a support bearing on one surface thereof (b) a photosensitive emulsion layer (i) a binder; (ii) a light-insensitive organic silver salt, (iii) a reducing agent, and (iv) a photosensitive silver halide emulsion; (c) an antihalation dye incorporated in the emulsion layer, in a polymer layer under the photosensitive layer, in the support, or in a backside polymer layer; and (d) one or more tinting dyes such that the final color space of the film lies within the range defined by $220° < h_{ab} < 260°$, where $h_{ab}$ is the psychometric hue angle, $h_{ab} = \arctan(b^*/a^*)$, as defined in the CIELAB color system.

16 Claims, 1 Drawing Sheet

PHOTOTHERMOGRAPHIC ELEMENT HAVING DESIRED COLOR

FIELD OF THE INVENTION

The present invention relates to a light sensitive photothermographic imaging element having the desired color. In particular it relates to a photothermographic element which contains an antihalation dye and one or more tinting dyes.

BACKGROUND OF THE INVENTION

It is well known in the photographic art to use blue colored polyester support, in particular polyethylene terephthalate (PET) containing 1,4-dianilino anthraquinone pigments, as a base support for radiographic recording elements. In general, these imaging films are spectrally sensitized to green light and undergo wet processing after X-Ray exposure to generate the silver image and remove residual colored materials contained within the film, such as sensitizing and filter (antihalation) dyes. The use of this type of blue support for radiographic film applications serves a psychometric purpose, in that radiologists are accustomed to viewing x-ray images with that background blue tone, and base their diagnoses on examination of films which have that blue tone. The pigment which imparts the blue color to the film serves no other purpose (such as spectral sensitization or antihalation) in such applications.

In recent years, imaging films which rely on the use of lasers, particularly solid state diode lasers, as the exposure source have been developed, which have required the use of antihalation and sensitizing dyes that absorb in the same region as the exposure device. Generally, these dyes do not impart a blue hue to the film as radiologists have come to expect, but as in more traditional radiological imaging films, this is of little consequence as long as the film undergoes subsequent wet processing steps that remove these residual colored materials. The limitation of this becomes obvious in trying to develop films based around so-called dry silver technology. These films utilize a light sensitive silver halide in catalytic proximity to a light insensitive, reducible silver source, along with a reducing agent for the silver source. The silver image is produced upon heating the element after exposure, without the need for wet processing. Residual sensitizing and antihalation dyes impart undesirable color to these films, making the images unacceptable from the colorimetric viewpoint of the radiologist, despite the fact that the images are acceptable in terms of other criteria, such as sharpness, $D_{min}$, contrast, etc.

It is known in the art that dyes can be incorporated into photosensitive materials to improve the color tone of developed silver of emulsion grains. The color tone of a developed silver image can often appear yellowish, particularly when using tabular grain emulsions, due to the yellow light produced by the scattering of blue light by the developed silver. Several variations of this technology have been disclosed in the art.

U.S. Pat. No. 4,847,149 discloses the use of fluorescent brightening agents to improve the color tone of a silver image in a sensitive material using tabular grain silver halide emulsions.

U.S. Pat. No. 4,818,675 discloses a technique for improving the blackness of a silver image by incorporation of a dye having maximum absorption between 520–580 nm in a sensitive material which uses tabular silver halide grains.

U.S. Pat. No. 5,213,951 discloses the use of a blue pigment having an absorption between 570–630 nm in a sensitive material comprising tabular silver halide grains to mask residual dye stain in the film.

U.S. Pat. No. 5,262,286 discloses the use of a tinting pigment in a sensitive reflection print material to compensate for the perceived yellowness of the sensitized material.

Various color toning agents which modify the color of the silver image of photothermographic emulsions to give a black or blue-black image are also well known in the art as exemplified by U.S. Pat. Nos. 4,123,282, 3,994,732, 3,846,136, and 4,021,249.

In all these cases, the coloring agent is added to mask dye stain or alter the perceived reflective tone of the silver image to make it colder (bluer). It would be desirable to have a photosensitive material, particularly a photothermographic material, which exhibited improved image tone with regard to the perceived background color, such that it matches the blue background color that radiologists prefer, and have come to expect in radiological films.

SUMMARY OF THE INVENTION

One aspect of this invention comprise a photothermographic element comprising:

(a) a support bearing on one surface thereof (b) a photosensitive emulsion layer comprising:
  (i) a binder;
  (ii) a light-insensitive organic silver salt,
  (iii) a reducing agent, and
  (iv) a photosensitive silver halide emulsion;

(c) an antihalation dye; and (d) one or more tinting dyes such that the final color space of the film lies within the range defined by $220° < h_{ab} < 260°$, where $h_{ab}$ is the psychometric hue angle, $h_{ab} = \arctan(b^*/a^*)$, as defined in the CIELAB color system.

The appropriate blue color is specified in terms of its CIELAB color space, as is discussed in great detail in the Principles of Color Technology $2^{nd}$ edition, F. W. Billmeyer and M. Saltzman, John Wiley and Sons, 1981, incorporated herein as reference. In the CIELAB color system, color space is described in terms of L*, a*, and b*, where L* is a measure of the chroma or brightness of a given color, a* is a measure of the red-green contribution, and b* is a measure of the yellow-blue contribution. For the purpose of the current invention, the blue color desired can be described in terms of its psychometric hue angle values, $h_{ab}$, where $h_{ab} = \arctan(b^*/a^*)$.

This color space is graphically represented by FIG. 1, a plot of the CIELAB a*, b* coordinates, with the hue angles of the starting support (the region encompassing lines 195°–205°), and the hue angles of the blue color desired (the region encompassing lines 220°–260°). More preferably, the desired blue color can be represented by the area encompassed by the hue angles 230°–250°. A combination of one or more tinting dyes incorporated into the film with the antihalation dye that allows the overall hue angle of the final film package to fall within the range $220° < h_{ab} < 260°$ dye describes a useful embodiment of the current invention.

DETAILED DESCRIPTION OF THE INVENTION

Figure 1:
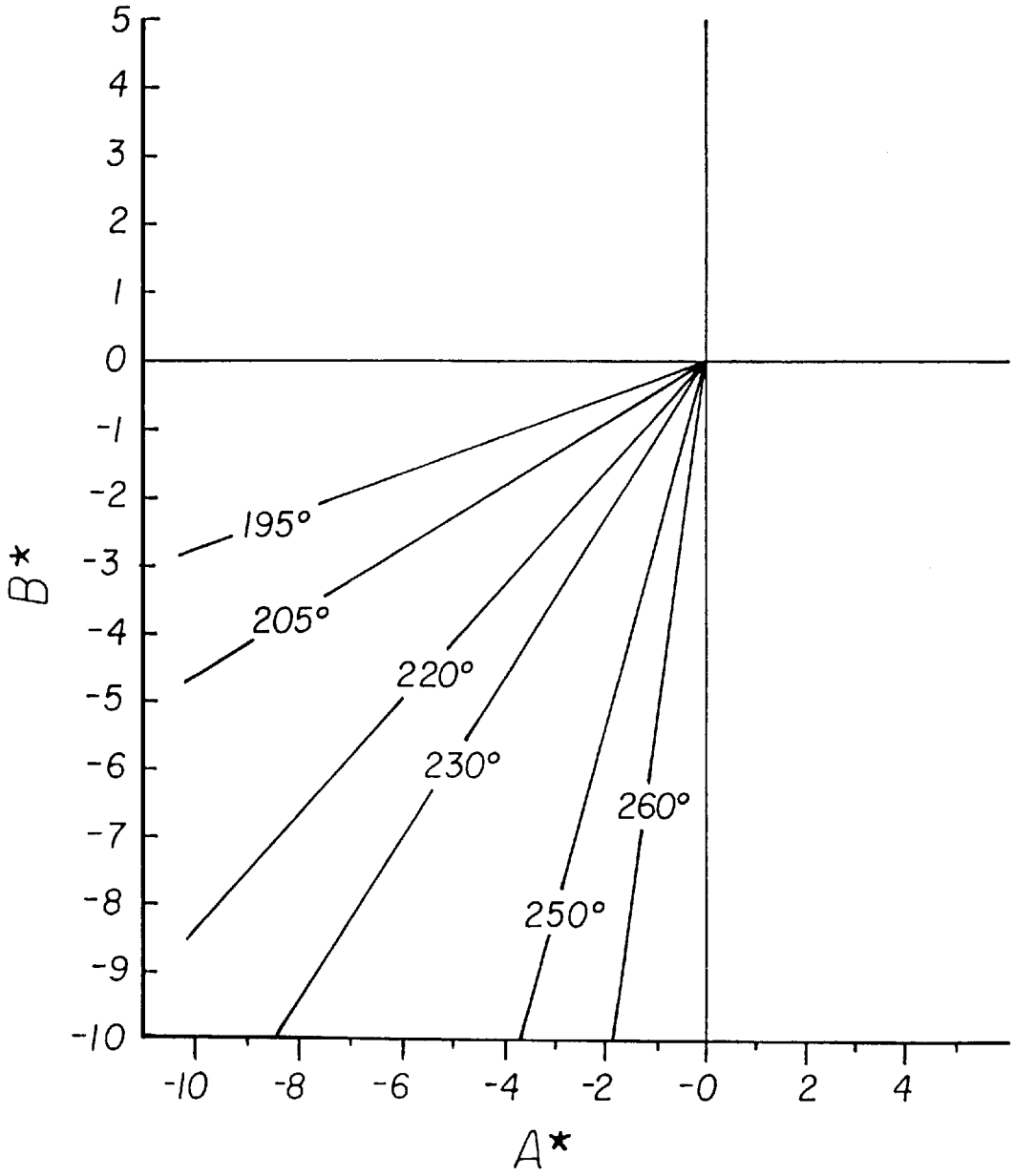
FIG. 1, a plot of the CIELAB a*, b* coordinates, with the hue angles of the starting support (the region encompassing lines 195°–205°), and the hue angles of the blue color desired (the region encompassing lines 220°–260°). More preferably, the desired blue color can be represented by the area encompassed by the hue angles 230°–250°.

As mentioned above, the photothermographic element contains an antihalation dye. Preferably the antihalation dye is incorporated in the support. Particularly useful antihalation dyes are those of formula I:

(I)

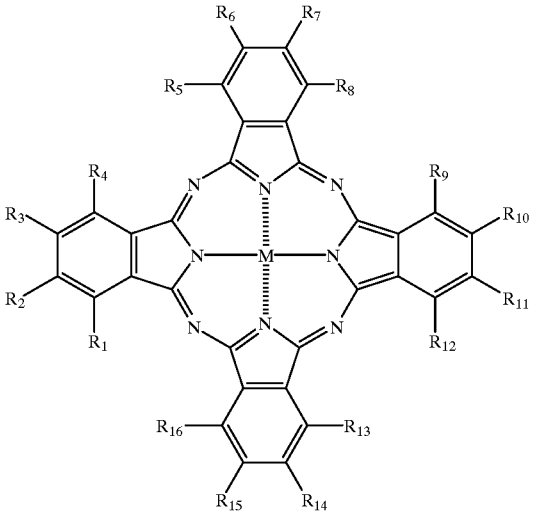

wherein:

$R_1$, $R_4$, $R_5$, $R_8$, $R_9$, $R_{12}$, $R_{13}$, $R_{16}$ independently represent hydrogen, or substituted or unsubstituted, branched or unbranched alkyl of 1–10 carbons atoms;

$R_2$, $R_3$, $R_6$, $R_7$, $R_{10}$, $R_{11}$, $R_{14}$, $R_{15}$ independently represent hydrogen, substituted or unsubstituted, branched or unbranched alkyl of 1–10 carbon atoms, substituted or unsubstituted aryl, halogen, substituted or unsubstituted alkoxyl of 1–10 carbons, substituted or unsubstituted aryloxy;

or $R_1$ and $R_2$, $R_2$ and $R_3$, $R_3$ and $R_4$, $R_5$ and $R_6$, $R_6$ and $R_7$, $R_7$ and $R_8$, $R_9$ $R_{10}$, $R_{10}$ and $R_{11}$, $R_{11}$ and $R_{12}$, $R_{13}$ and $R_{14}$, $R_{14}$ and $R_{15}$ and/or $R_{15}$ and $R_{16}$ taken together may represent the atoms necessary to form a substituted or unsubstituted 6 membered aromatic or heteroaromatic ring;

M is a multi-valent metal selected from: Mg, Ca, Sr, Ti, V, Cr, Mn, Fe, Co, Ni, Cu, Zn, B, Al, Sn, Pb, Mo, Pd and Pt.

Alkyl and alkoxy groups preferably contain 1 to 10 carbon atoms, more preferably 1 to 6 carbon atoms. Alkyl groups include, for example, methyl, ethyl, propyl, isopropyl, butyl, sec-butyl, tert-butyl, heptyl decyl, etc. Alkoxy groups include, for example, methoxy, ethoxy, propoxy, tert-butoxy, etc. Aryl and aryloxy groups preferably contain 6 to 12 carbon atoms, more preferably 5 to 8 carbon atoms. Aryl groups that can be used include, for example, phenyl, tolyl, naphthyl, 2,4-dimethylphenyl, 2-ethylphenyl, 3-ethylphenyl, 4-ethylphenyl, 2-isopropylphenyl, 3-isopropylphenyl, 4-isopropylphenyl, 4-tert-butylphenyl, 2-methoxyphenyl, 3-methoxyphenyl, 4-methoxyphenyl, 2-ethoxyphenyl, 4-ethoxyphenyl, 4-isopropoxyphenyl, etc. Aryloxy groups, include, for example, phenoxy, substituted phenoxy such as 2-methylphenoxy, 4-methylphenoxy, 2-ethylphenoxy, 4-ethylphenoxy, 4-cumylphenoxy, 4-isopropylphenoxy, 4-tert-butyl-phenoxy, 2-chlorophenoxy, 4,-chlorophenoxy, etc.

Aromatic ring structures include, for example phenyl, 1,2-naphthyl, 2,3-naphthyl, phenanthryl, etc. Heteroaromatic rings include, for example, pyridine, pyrazine, pyridazine and pyrimidine.

When reference in this application is made to a particular group it is to be understood that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photothermographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Dyes of structure I can be made by the methods outlined in *The Phthalocyanines,* Vol. I and II, Moser, F. H. and Thomas, A. L., CRC Press, Boca Raton, Fla., 1983 or by the method of Wöhrle, D.; Schnurpfeil, G.; Knothe, G. Dyes and Pigments 1992, 18, 91.

Preferred antihalation dyes for use in this invention are represented, but not limited to, the examples shown in Table 1:

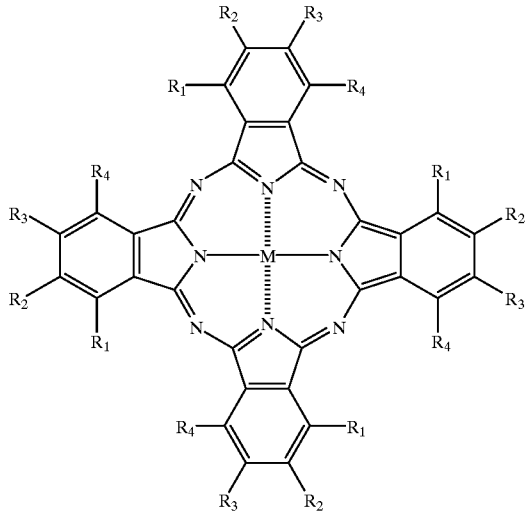

TABLE 1

| Dye | $R_1/R_4$ | $R_2/R_3$ | M | Sol'n. $l_{max}$ |
|---|---|---|---|---|
| I-1 | H | t-butyl | Co | 661 nm |
| I-2 | H | t-butyl | Cu | 677 nm (toluene) |
| I-3 | H | t-butyl | Fe | 684 nm |
| I-4 | H | t-butyl | Mg | 672 nm |
| I-5 | H | t-butyl | Ni | 669 nm |
| I-6 | H | t-butyl | Zn | 671 nm |
| I-7 | H | 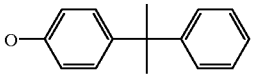 | Cu | 681 nm |
| I-8 | H | OPh | Ni | 672 nm |
| I-9 | H | 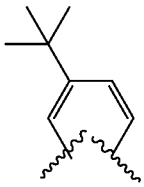 | Ni | 766 nm |
| I-10 | H | 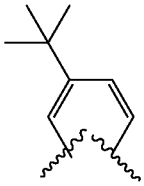 | Zn | 755 nm |
| I-11 | H | 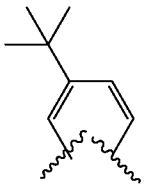 | Cu | 770 nm |
| I-12 | H | 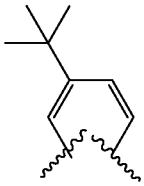 | Mg | 769 nm |
| I-13 | 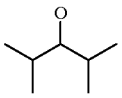 | H | Mg | 702 nm |
| I-14 | H | $(CH_3)_3CO$ | Mg | 677 nm |
| I-15 | H | $(CH_3)_3CO$ | Zn | 676 nm |
| I-16 | H | $(CH_3)_3CO$ | Cu | 680 nm |
| I-17 | F | F | Zn | 630 nm |

The antihalation dye may be incorporated in the film in an appropriate polymer on the backside opposite the light sensitive emulsion layer, directly in the support itself during the support extrusion or casting process, in an antihalation undercoat layer directly between the light sensitive emulsion layer and the support, or in the emulsion layer itself. Appropriate polymers can be chosen from poly(vinyl butyral), cellulose acetate, polyethylene terephthalate, polyethylene naphthalate.

The tinting dyes of the current invention may be selected from the following classes of dyes, but are not limited to these specific classes, so long as the CIELAB color space after tinting meets the requirements specified above:

(II)

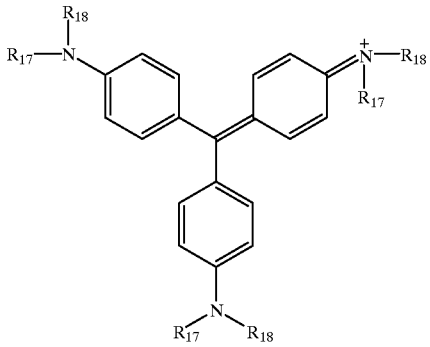

wherein:

$R_{17}$ and $R_{18}$ can be the same or different group selected from hydrogen, substituted or unsubstituted alkyl, substituted or unsubstituted cycloalkyl, substituted or unsubstituted aryl. Alkyl groups preferably contain 1 to 12 carbon atoms and include, for example, methyl, ethyl, propyl, isopropyl, butyl sec. butyl, tert-butyl, heptyl decyl, etc. Substituted alkyl groups include hydroxyethyl, sulfoethyl, sulfopropyl, sulfobutyl, carboxyethyl, carboxymethyl, carbethoxyethyl, cyanoethyl and aminoethyl. Cycloalkyl groups preferable contain 1 to 10 carbon atoms and include, for example, cyclopropyl, cyclopentyl and cyclohexyl. Aryl groups preferably containg 6 to 12 carbon atoms and include, for example, phenyl, tolyl, naphthyl, 2,4-dimethylphenyl, 2-ethylphenyl, 3-ethylphenyl, 4-ethylphenyl, 2-isopropylphenyl, 3-isopropylphenyl, 4-isopropylphenyl, 4-tert-butylphenyl, 2-methoxyphenyl, 3-methoxyphenyl, 4-methoxyphenyl, 2-ethoxyphenyl, 4-ethoxyphenyl, 4-isopropoxyphenyl, 3-sulfophenyl, 4-sulfophenyl, etc.

(III)

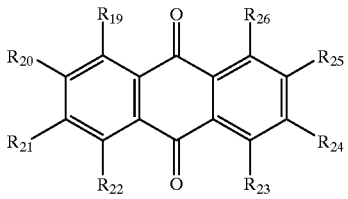

wherein:

$R_{19}$ through $R_{26}$ each represent a hydrogen atom, a hydroxyl group, an alkoxyl group, a substituted or unsubstituted aryloxy group, or a substituted or unsubstituted amino group.

(IV)

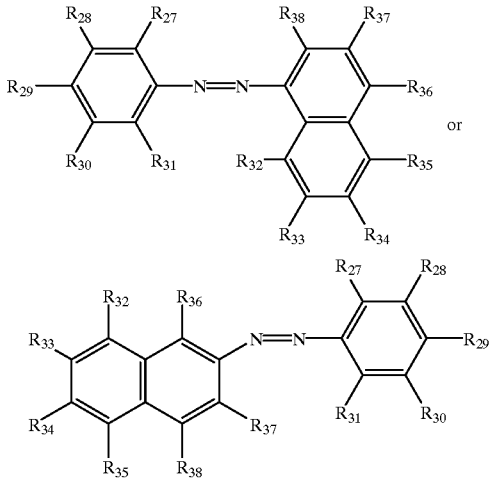

wherein:

$R_{27}$ through $R_{38}$ each represent a hydrogen atom, a hydroxyl group, a substituted or unsubstituted amino group, a sulfonate group, a nitro group, an alkoxyl group, an alkyl group, an aromatic substituted diazo group, or a divalent group capable of forming a bond with a metal atom to provide a metal-complexed dye.

(V)

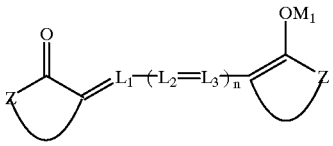

wherein:

Z comprises the elements to complete a cyclic or heterocyclic ring system; $L_1$,$L_2$, and $L_3$ are unsubstituted or substituted methine groups, and n=0–2. Examples of substituents on the methines include $C_1$–$C_6$ alkyl, substituted or unsubstituted amido, substituted or unsubstituted phenyl, or a heteroaromatic ring system such as pyridyl, pyrimidinyl, or imidazoyl. $M_1$ can be a hydrogen atom, trialkylammonium group, or a cationic, monovalent metal such as $Na^+$ or $K_+$.

Some examples of specific tinting dye structures that are useful for the present invention are shown below.

II-1

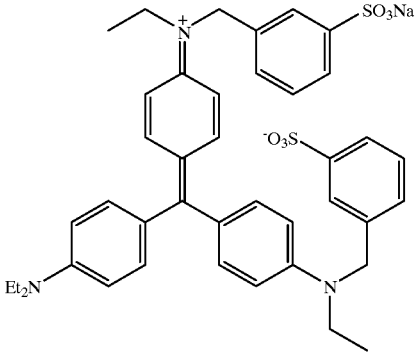

II-2

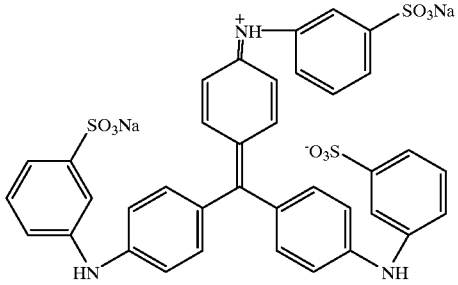

II-3

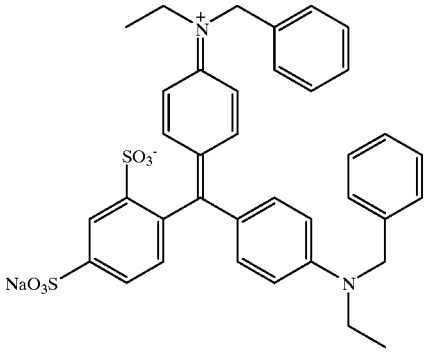

II-4

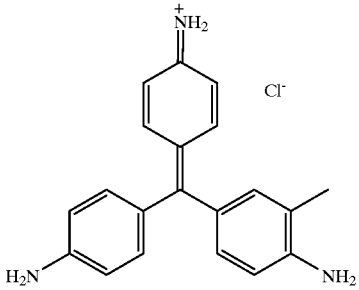

-continued
II-5
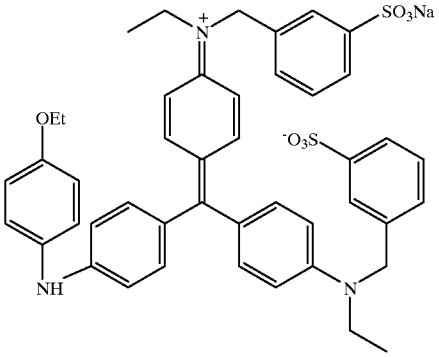
II-6
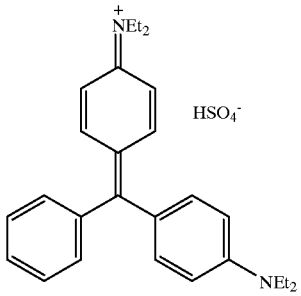
II-7
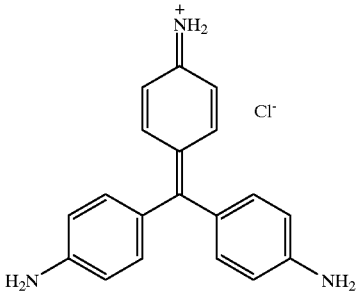
II-8
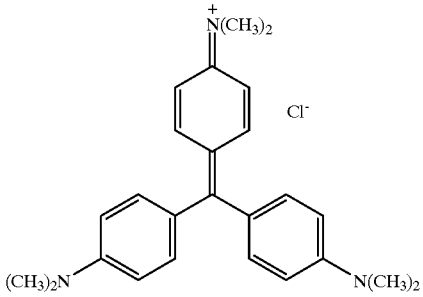
II-9
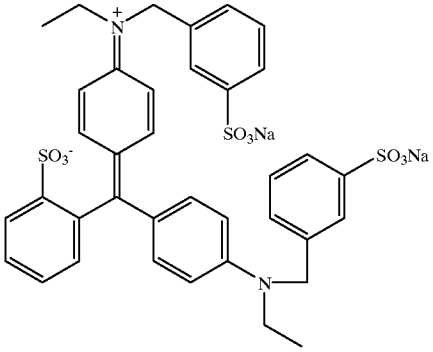
II-10
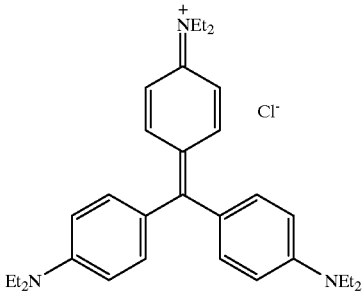
II-11
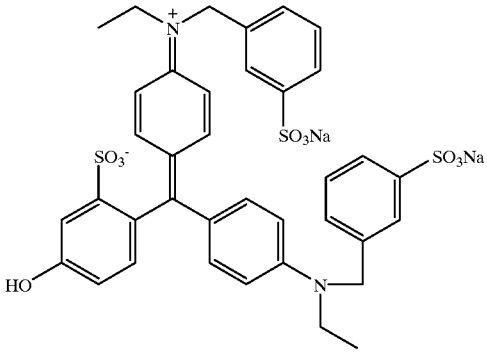
II-12
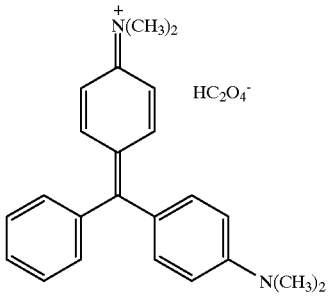

-continued
II-13
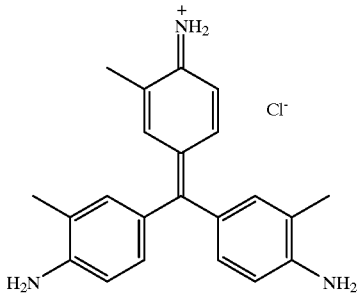
II-14
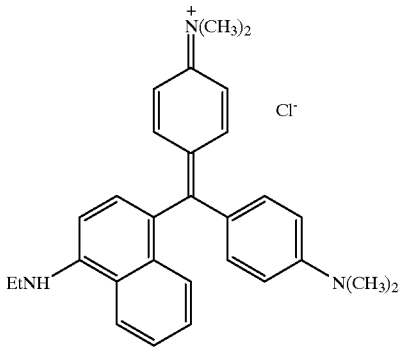
III-1
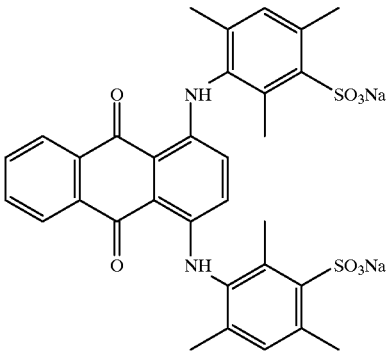
III-2
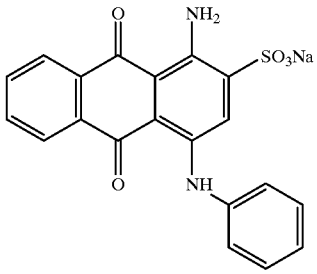
III-3
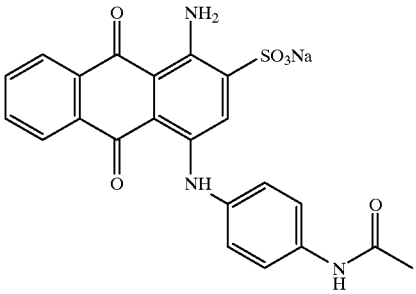
III-4
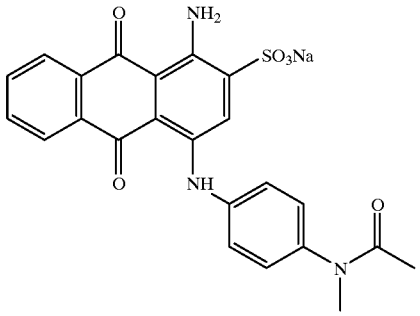
III-5
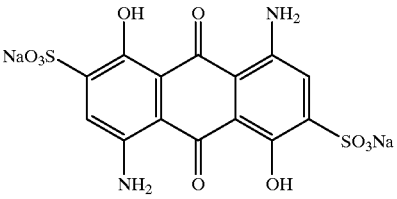
III-6
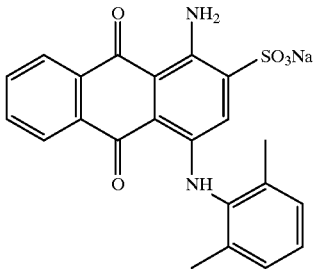

-continued
III-7
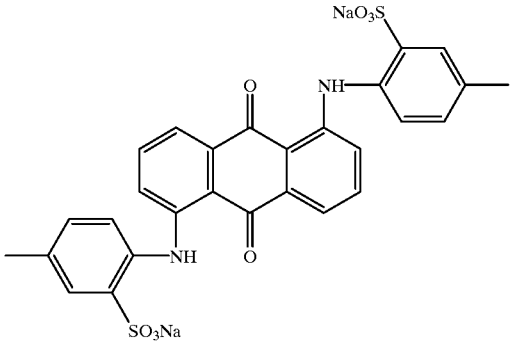
III-8
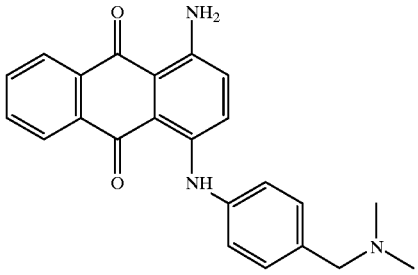
III-9
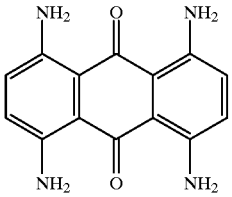
III-10
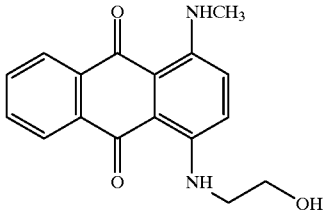
III-11
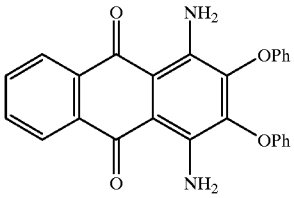
IV-1
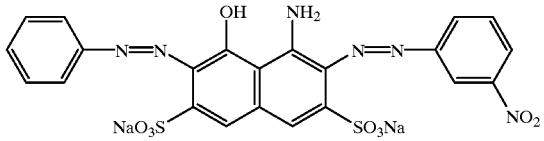
IV-2
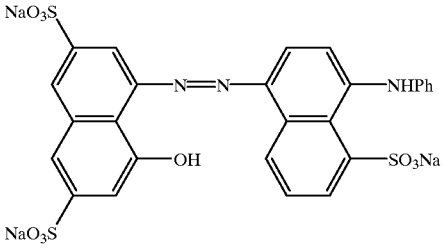
IV-3
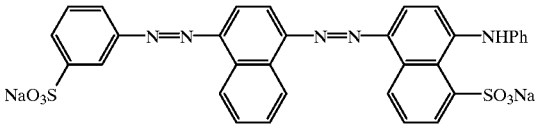
IV-4
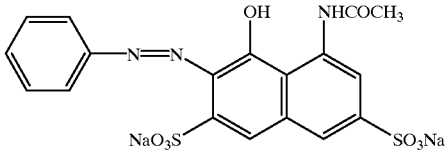
IV-5
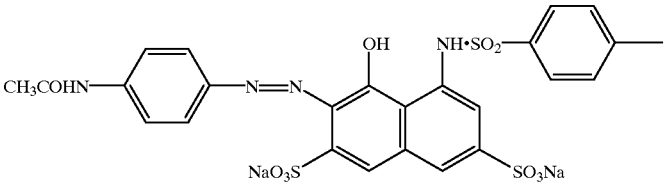

-continued
IV-6
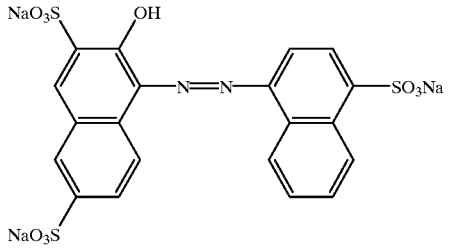
IV-7
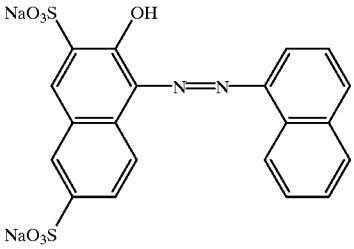
IV-8
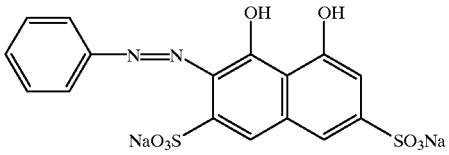
IV-9
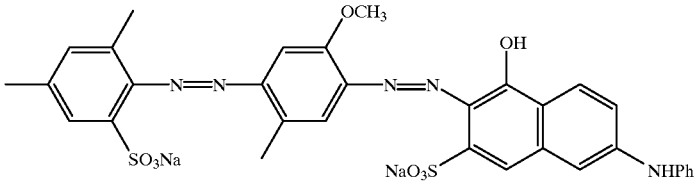
IV-10
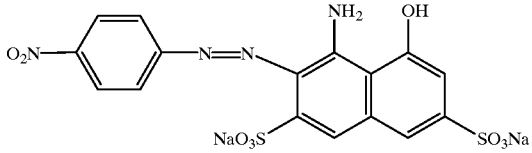
IV-11
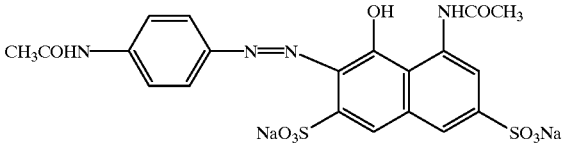
IV-12
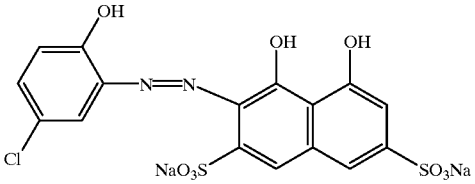
IV-13
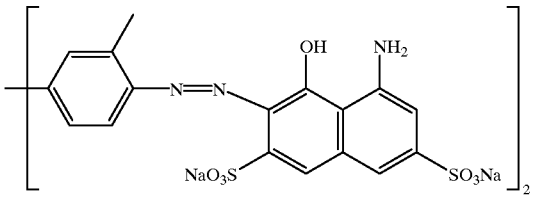
V-1
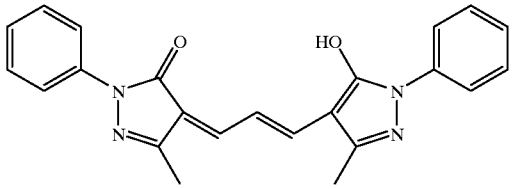
V-2
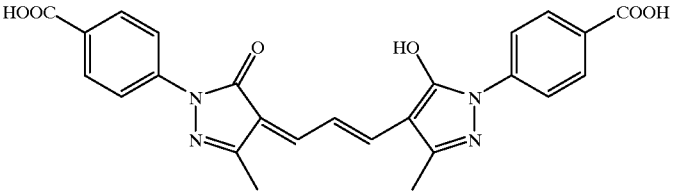

-continued
V-3
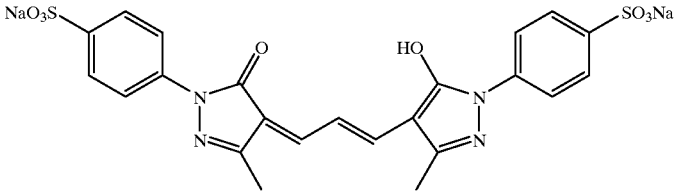
V-4
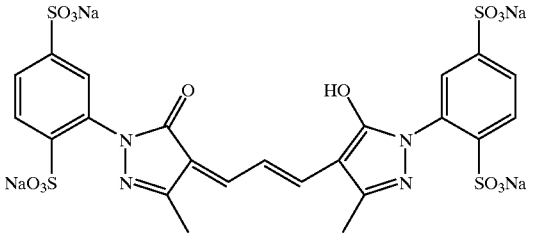
V-5
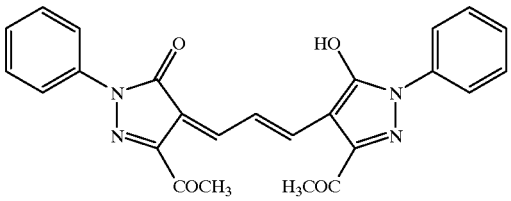
V-6
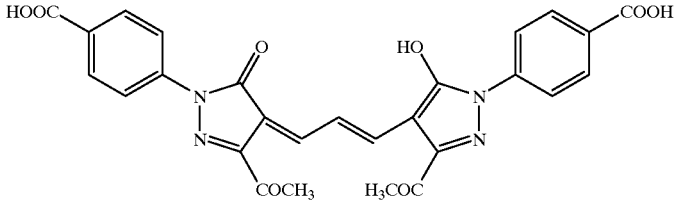
V-7
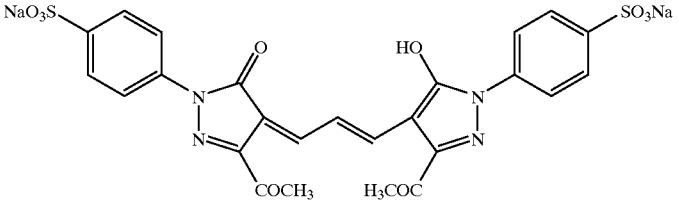
V-8
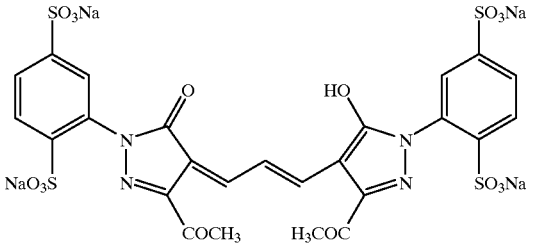
V-9
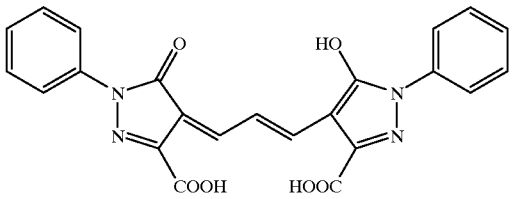
V-10
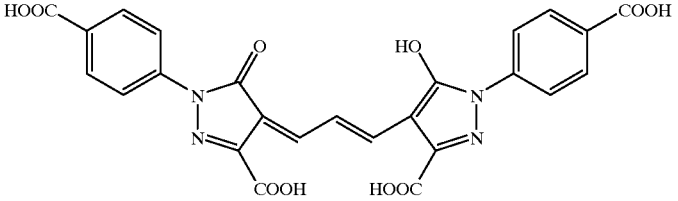
V-11
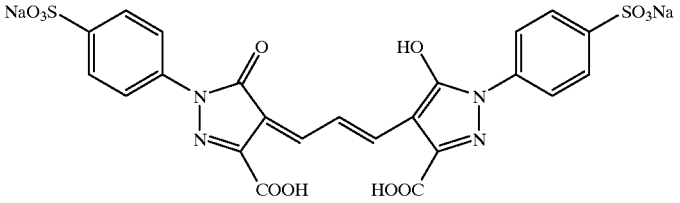

-continued

V-12

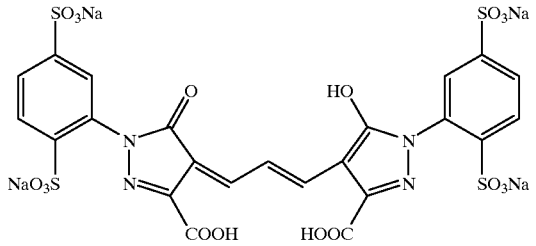

V-13

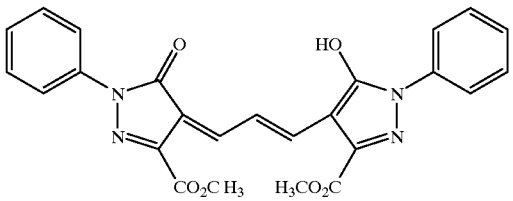

V-14

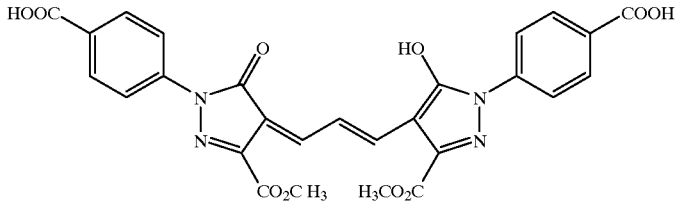

V-15

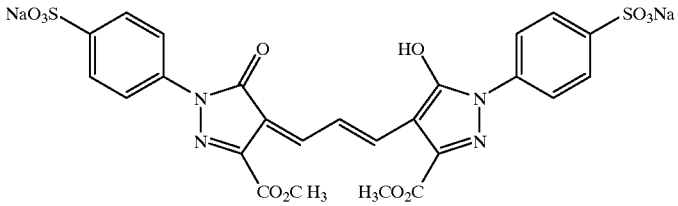

V-16

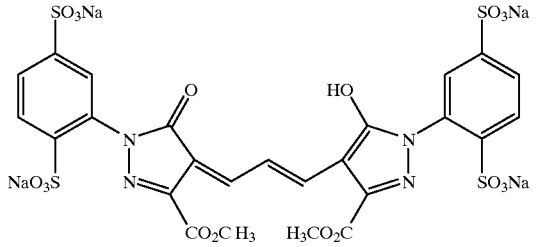

A typical photothermographic element comprises a support, a photothermographic layer, a backing layer, an overcoat layer and various interlayers, such as, subbing layers, filter layers and the like.

The layers of a photothermographic element are generally prepared from a solution containing a binder and other components to give the layer the desired properties in an appropriate solvent. Preferred solvents are, for example, aromatic solvents, such as, toluene or xylene, ketone solvents, such as, methyl ethyl ketone, methyl isobutyl ketone and the like, tetrahydrofuran, ethyl acetate, chlorinated solvents such as dichloromethane and the like. The solvent can contain water, if desired.

Typical photothermographic elements of this invention comprise at least one photothermographic layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure,* June 1978, Item No. 17029, the entire disclosures of which are incorporated herein by reference.

In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499 the entire disclosure of which is incorporated herein by reference. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075 the entire disclosure of which is incorporated herein by reference, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-1-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure,* June 1978, Item No. 17029 the entire disclosures of which are incorporated herein by reference. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282, the entire disclosures of which are incorporated herein by reference. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350, the entire disclosure of which is incorporated herein by reference. Other examples of useful stabilizers include azole thioethers and blocked azolinethione stabilizer precursors and carbamoyl stabilizer precursors, such as described in U.S. Pat. No. 3,877,940, the entire disclosure of which is incorporated herein by reference.

The photothermographic elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, other absorbing and filter dyes, such as described in *Research Disclosure,* December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

A photothermographic element typically has a transparent protective layer comprising a film forming binder, preferable a hydrophilic film forming binder. Such binders include, for example, crosslinked polyvinyl alcohol, gelatin, poly(silicic acid), and the like. Particularly preferred are binders comprising poly(silicic acid) alone or in combination with a water-soluble hydroxyl-containing monomer or polymer as described in the U.S. Pat. No. 4,828,971, the entire disclosure of which is incorporated herein by reference.

The term "protective layer" is used in this application to mean a transparent, image insensitive layer that can be an overcoat layer, that is a layer that overlies the image sensitive layer(s), or a backing layer, that is a layer that is on the opposite side of the support from the image sensitive layer (s). The imaging element can contain an adhesive interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described in U.S. Pat. No. 5,547,821, the entire disclosure of which is incorporated herein by reference.

A photothermographic imaging element generally includes at least one transparent protective layer containing matte particles. Either organic or inorganic matte particles can be used. Examples of organic matte particles are often in the form of beads, of polymers such as polymeric esters of acrylic and methacrylic acid, e.g., poly (methylmethacrylate), styrene polymers and copolymers, and the like. Examples of inorganic matte particles are of glass, silicon dioxide, titanium dioxide, magnesium oxide, aluminum oxide, barium sulfate, calcium carbonate, and the like. Matte particles and the way they are used are further described in U.S. Pat. Nos. 3,411,907, 3,754,924, 4,855,219, 5,279,934, 5,288,598, 5,378,577, and commonly assigned copending patent application Ser. Nos. 08/421,178 filed Apr. 13, 1995, and 08/330,406, filed Oct. 28, 1994, the entire disclosures of which are incorporated herein by reference.

A wide variety of materials can be used to prepare the protective layer that is compatible with the requirements of photothermographic elements. The protective layer should be transparent and should not adversely affect sensitometric characteristics of the photothermographic element such as minimum density, maximum density and photographic speed. Useful protective layers include those comprised of poly(silicic acid) and a water-soluble hydroxyl containing monomer or polymer that is compatible with poly(silicic acid) as described in U.S. Pat. Nos. 4,741,992 and 4,828, 971, the entire disclosures of which are incorporated herein by reference. A combination of poly(silicic acid) and poly (vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy)ethyl-trimethylammonium methosulfate, crosslinked gelatin, polyesters and polyurethanes.

Particularly preferred protective layers are described in above-mentioned U.S. Pat. Nos. 5,310,640 and 5,547,821, the entire disclosures of which are incorporated herein by reference.

The photothermographic elements are exposed by means of various forms of energy, including those to which the photographic silver halides are sensitive, e.g., include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

Heating means known in the photothermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The following examples illustrate the photothermographic element of this invention.

Dye Concentrate Pellet Formulation

Several different approaches to incorporate the antihalation and/or tinting dyes for use in the present invention into polyester resin concentrates were used as illustrated below.

EXAMPLE 1

For dye quantities up to 10 grams, the following procedure was followed. Polyester (polyethylene terephthalate) pellets (nominal batch size was 40 grams of resin) were melted in a Banbury PL 750 mixer prior to adding the dye. The pellets were melted at 277° C. for 90 sec with stirring (20 rpm). The dye was then added at 5 weight % to the molten polymer, the blend was stirred at 20 rpm for 45 sec, and then at 45 rpm for 60 sec. The mixer was then stopped, and the molten material was collected on a metal plate. After cooling, the material was ground using a 2 mm screen. This was combined with polyester pellets in a suitable container and physically mixed to achieve the final dye loadings of 25–1000 ppm.

EXAMPLE 2

For dye quantities up to 100 grams, the dye was physically blended (by shaking in a suitable container like a plastic bag) at a final desired concentration of 0.01 to 1.0 weight %. The blend was fed into a Werner & Pfleiderer ZDS-K28 twin screw compounder with a final melt temperature of 266° C., and was extruded as strands. The strands were cooled in a water bath at about 30° C., and subsequently chopped to yield pellets.

EXAMPLE 3

For dye quantities over 100 grams, the dye and polyester pellets were put in separate feed hoppers of a Welding Engineers twin-screw compounder. The dye feed rate was adjusted to between 0.1 and 10 weight % (most preferably between 0.5 and 6.0 weight %) of the total. The melt temperature was 236° C. and the compounded material was extruded as a strand which was cooled with a water bath maintained at 42° C. and chopped to yield pellets.

Production of Polyester Support with Incorporated Dye

Again, as with the manufacture of concentrate pellets, several methods were used to manufacture polyester support containing the dyes of the present invention, depending on the quantities of material needed. In all cases, the polyester pellets and dye blends were dried for at least sixteen hours at 80–100° C. prior to film casting.

EXAMPLE 4

For final blends of 2 kg or less, the polyester pellets and the dye concentrate (0.1 to 10 weight %) were physically combined and mixed in a ratio to yield final, desired dye loading (25–1000 ppm). The blend was then placed in the feed hopper of the Randcastle extruder and a cast film of about 254 microns thickness and 12.7 cm width was produced. Although the film uniformity was poor, this method did provide data as to thermal stability of the dye during extrusion and absorbance characteristics of the cast film.

EXAMPLE 5

For final blends of up to 5 kg, the polyester pellets were physically combined with the dye concentrate pellets (0.1 to 10 weight %, preferably 0.5 to 7 weight % dye) and mixed in a ratio to yield final, desired dye loading (10–10000 ppm, preferably 25–1000 ppm). The desired casting conditions were established on a Killion cast film line, using unblended polyester pellets. Once a stable film of 177–203 microns thickness and 12.7 cm in width was obtained, the feed hopper was drained and the blend placed in the feed hopper. Additional unblended polyester pellets were added on top of the blend to insure accurate feed rates. This procedure yielded uniform cast films of 170 to 205 micron thickness.

EXAMPLE 6

For final blends of up to 5 kg, the polyester pellets were physically combined with the dye concentrate (0.1 to 10 weight %, preferably 0.5 to 6 weight %) and mixed in a ratio to yield final, desired dye loading (10–10000 ppm, preferably 25–1000 ppm). The desired casting conditions were established on a Davis-Standard Thermatic Model 2SIN25 biaxial film line to produce biaxially oriented films nominally 178 microns in thickness with a combined stretch ratio of from 9.0 to 16.0, most preferably from 11.5 to 14.0. Once a stable film was established with unblended polyester, the feed hopper was drained and the blend was introduced into the feed hopper. As the level in the hopper began to decrease, additional unblended polyester pellets were added to the feed hopper. This procedure yielded uniform, biaxially oriented films after the transition from clear to dyed support was complete.

EXAMPLE 7

The desired casting conditions were established on a biaxial film line to produce biaxially oriented films nominally 178 microns in thickness with a combined stretch ratio of from 9.0 to 16.0, most preferably from 11.5 to 14.0. Once a stable film was established with unblended polyester, a dye concentrate (0.1 to 10 weight %, preferably 0.5 to 6 weight %) was added to the feed stream from a secondary feed hopper at a rate sufficient to achieve a final dye loading of 50 to 800 ppm. This procedure yielded uniform, biaxially oriented films once the transition from clear to dyed support was complete.

EXAMPLE 8

The following components were mixed to form an emulsion (A):

| Component | Grams |
|---|---|
| Silver Behenate dispersion (contains 28.0% by weight silver behenate in 7.0% by weight methyl ethyl ketone (MEK)/toluene (80:20) solution of polyvinylbutyral (Butvar B-76 which is a trademark of and available from the Monsanto Co., U.S.A)) (organic silver salt oxidizing agent) | 918.5 |
| Silver bromide (silver bromide emulsion contains 42.03 g Ag in 8.6% by weight MEK solution of Butvar B-76) containing sodium Iodide (NaI) (0.1% by weight) (speed increasing addendum) | 171.4 |
| Sensitizing dye (0.17% by weight solution in MEK/2-ethoxy ethanol (90:10)) | 80.1 |
| Succinimide (toner) | 4.9 |
| Phthalimide (toner) | 9.7 |
| SF-96 (10% by weight SF-96 in MEK. SF-96 is a silicone and is a tradename of General Electric Co., U.S.A.) (surfactant) | 1.7 |
| 2-Bromo-2-[(4-methylphenyl)sulfonyl] acetamide (antfoggant) | 2.7 |
| Naphthyl triazine (print-up stabilizer) | 0.6 |
| Palmitic acid (10% by weight in 10.5% by weight MEK solution of Butvar B-76)(antifoggant) | 32.6 |
| N (4-hydroxyphenyl)benzenesulfonamide (12% by weight in 10.5% by weight MEK/Methanol (50:50) solution of Butvar B-76) (developing agent) containing 0.74% Trimethyl Borate (crosslinking agent) | 539.5 |
| Buvar B-76 (18.3% by weight in MEK/Toluene/Methanol 86:2:12) (binder) | 45.2 |
| Copper(II) 2,9,16,23-tetra-tert-butyl-29H,31H-phthalocyanine I-2 (2.5% by weight in toluene) (acutance dye) | 2.3 |
| Dye III-11 (1.5% by weight in toluene) (tinting dye) | 31.0 |

The resulting photothermographic solution silver halide composition was coated at a wet laydown of 79.6 grams/$m^2$ on the polyethylene terephthalate film support from example 7. The coating was permitted to dry and was then overcoated with the following composition:

| Component | Grams |
|---|---|
| Distilled Water | 453.4 |
| Polyvinyl Alcohol (PVA) (6.4% by weight in distilled water) (binder) | 334.0 |
| Tetraethyl Orthosilicate (35.4% by weight in methanol/water (53:47)) (hardner) | 195.8 |
| p-Toluene Sulfonic Acid | 0.4 |
| Lodyne S-100 (7.75% by weight in water) (surfactant) | 0.2 |

-continued

| Component | Grams |
|---|---|
| Olin 10G (10% by weight in distilled water. Olin 10G is para-isononylphenoxy polyglycidol and is a trademark of and available from the Olin Corp., U.S.A.) (surfactant) | 8.0 |
| Mm-100 matte (2.5 micron) (40% by weight in a in water solution) (matting agent) | 1.0 |
| Dye II-2 (1% in water) (tinting dye) | 3.7 |

The dyes used in this example are:

III-11

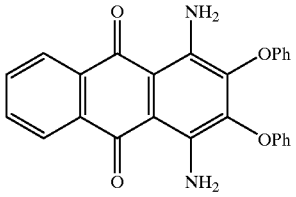

and

II-2

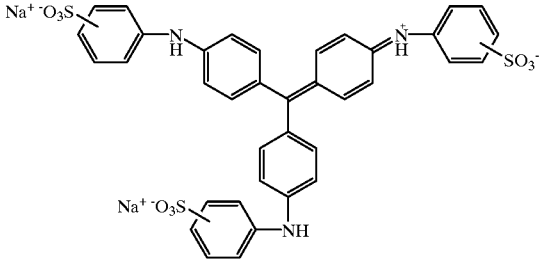

The resulting overcoat formulation was coated at a wet laydown of 40.4 grams/m$^2$. The coating was permitted to dry.

The resulting photothermographic element was exposed using a 683 nm laser and processed at 124° C. for 5 sec to provide images.

EXAMPLE 9

The following components were mixed to form an emulsion (A):

| Component | Grams |
|---|---|
| Silver Behenate dispersion (contains 28.0% by weight silver behenate in 7.0% by weight methyl ethyl ketone (MEK)/toluene (80:20) solution of polyvinylbutyral (Butvar B-76 which is a trademark of and available from the Monsanto Co., U.S.A)) (organic silver salt oxidizing agent) | 877.0 |
| Silver bromide (silver bromide emulsion contains 42.03 g Ag in 8.6% by weight MEK solution of Butvar B-76) containing sodium Iodide (NaI) (0.1% by weight) (speed increasing addendum) | 163.3 |
| Sensitizing dye (0.17% by weight solution in MEK/2-ethoxy ethanol (90:10)) | 76.3 |
| Succinimide (toner) | 4.7 |
| Phthalimide (toner) | 9.3 |
| SF-96 (10% by weight SF-96 in MEK. SF-96 is a silicone and is a tradename of General Electric Co., U.S.A.) (surfactant) | 1.6 |
| 2-Bromo-2-[(4-methylphenyl)sulfonyl] acetamide (antfoggant) | 2.6 |
| Naphthyl triazine (print-up stabilizer) | 0.6 |
| Palmitic acid (10% by weight in 10.5% by weight MEK solution of Butvar B-76)(antifoggant) | 31.1 |
| N (4-hydroxyphenyl)benzenesulfonamide (12% by weight in | 513.8 |

-continued

| Component | Grams |
|---|---|
| 10.5% by weight MEK/Methanol (50:50) solution of Butvar B-76) (developing agent) containing 0.74% Trimethyl Borate (crosslinking agent) | |
| Buvar B-76 (18.3% by weight in MEK/Toluene/Methanol 77:12:11) (binder) | 43.1 |
| Copper(II) 2,9,16,23-tetra-tert-butyl-29H,31H-phthalocyanine, I-2 (0.25% by weight in toluene) (acutance dye) | 10.8 |

The resulting photothermographic solution silver halide composition was coated at a wet laydown of 79.6 grams/m$^2$ on the polyethylene terephthalate film support from example 7. The coating was permitted to dry and was then overcoated with the following composition:

| Component | Grams |
|---|---|
| Distilled Water | 334.3 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Methylmethacrylate matte (2.5 micron) (24.5 by weight in a 1% gelatin in water solution) (matting agent) | 1.2 |
| Dye II-2 (1% in water) (tinting dye) | 8.0 |

The resulting overcoat formulation was coated at a wet laydown of 40.4 grams/m$^2$. The coating was permitted to dry. Then the pelloid side was coated with the following composition:

| Component | Grams |
|---|---|
| Distilled Water | 242.2 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Styrene-divinylbenzene (50/50) matte (5.0 micron) (24.5 by weight in a 1% gelatin in water solution) (matting agent) | 1.2 |
| Basilen Violet F-5R (1% in water) (tinting dye) (a proprietary dye of the BASF Corporation). | 100.0 |

The resulting photothermographic element was exposed using a 683 nm and processed at 124° C. for 5 sec to provide images.

EXAMPLE 10

The following components were mixed to form an emulsion (A):

| Component | Grams |
|---|---|
| Silver Behenate dispersion (contains 28.0% by weight silver behenate in 7.0% by weight methyl ethyl ketone (MEK)/toluene (80:20) solution of polyvinylbutyral (Butvar B-76 which is a trademark of and available from the Monsanto Co., U.S.A)) (organic silver salt oxidizing agent) | 877.0 |
| Silver bromide (silver bromide emulsion contains 42.03 g Ag in 8.6% by weight MEK solution of Butvar B-76) containing sodium Iodide (NaI) (0.1% by weight) (speed increasing addendum) | 163.3 |
| Sensitizing dye (0.17% by weight solution in MEK/2-ethoxy ethanol (90:10)) | 76.3 |
| Succinimide (toner) | 4.7 |
| phthalimide (toner) | 9.3 |
| SF-96 (10% by weight SF-96 in MEK. SF-96 is a silicone and is a tradename of General Electric Co., U.S.A.) (surfactant) | 1.6 |
| 2-Bromo-2-[(4-methylphenyl)sulfonyl] acetamide (antfoggant) | 2.6 |
| Naphthyl triazine (print-up stabilizer) | 0.6 |
| Palmitic acid (10% by weight in 10.5% by weight MEK solution of Butvar B-76)(antifoggant) | 31.1 |
| N (4-hydroxyphenyl)benzenesulfonamide (12% by weight in 10.5% by weight MEK/Methanol (50:50) solution of Butvar B-76) (developing agent) containing 0.74% Trimethyl Borate (crosslinking agent) | 513.8 |
| Butvar B-76 (18.3% by weight in MEK/Toluene/Methanol 77:12:11) (binder) | 43.1 |
| Copper(II) 2,9,16,23-tetra-tert-butyl-29H,31H-phthalocyanine I-2 (0.25% by weight in toluene)(acutance dye) | 10.8 |

The resulting photothermographic solution silver halide composition was coated at a wet laydown of 79.6 grams/m2 on a clear polyethylene terephthalate film support. The coating was permitted to dry and was then overcoated with the following composition:

| Component | Grams |
|---|---|
| Distilled Water | 342.3 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Methylmethacrylate matte (2.5 micron) (24.5 by weight in a 1% gelatin in water solution) (matting agent) | 1.2 |

The resulting overcoat formulation was coated at a wet laydown of 40.4 grams/m2. The coating was permitted to dry. Then the pelloid side was coated with the following composition:

| Component | Grams |
|---|---|
| Butvar B-76 (Butvar B-76 which is a trademark of and available from the Monsanto Co., U.S.A) (15.5% by weight in MEK/Toluene/Methanol 71:9:20) (binder) | 232.3 |
| 3,3',4,4'-Benzophenonetetracarboxylic dianhydride (5.0% by weight in Acetone) | 10.8 |
| 2-Pyrazoline-3-carboxylic acid, 4-(3-(3-carboxy-5-hydroxy-1-phenylpyrazol-4-yl)allylidene)-5-oxo-1-phenyl-1-, diethyl ester, compd. with triethylamine (1:1) (1% by weight in MEK) (tinting dye V-13) | 18.7 |
| Magnesium(II) 2,9,16,23-tetra-tert-butyl-29H,31H-phthalocyanine I-4 (1.0% by weight in toluene) (antihalation dye) | 47.8 |

The resulting solution composition was coated at a wet laydown of 29.70 grams/m2 on a clear polyethylene terephthalate film support. The coating was permitted to dry and was then overcoated with the following composition:

| Component | Grams |
|---|---|
| Distilled Water | 342.2 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Styrene-divinylbenzene (50/50) matte (5.0 micron) (24.5 by weight in a 1% gelatin in water solution) (matting agent) | 1.2 |

The resulting photothermographic element was exposed using a 683 nm laser and processed at 125° C. for 5 sec to provide images.

EXAMPLE 11

The following components were mixed to form an emulsion (A):

| Component | Grams |
|---|---|
| Silver Behenate dispersion (contains 28.0% by weight silver behenate in 7.0% by weight methyl ethyl ketone (MEK)/toluene (80:20) solution of polyvinylbutyral (Butvar B-76 which is a trademark of and available from the Monsanto Co., U.S.A)) (organic silver salt oxidizing agent) | 877.0 |
| Silver bromide (silver bromide emulsion contains 42.03 g Ag in 8.6% by weight MEK solution of Butvar B-76) containing sodium Iodide (NaI) (0.1% by weight) (speed increasing addendum) | 163.3 |
| Sensitizing dye (0.17% by weight solution in MEK/2-ethoxy ethanol (90:10)) | 76.3 |
| Succinimide (toner) | 4.7 |
| Phthalimide (toner) | 9.3 |
| SF-96 (10% by weight SF-96 in MEK. SF-96 is a silicone and is a tradename of General Electric Co., U.S.A.) (surfactant) | 1.6 |
| 2-Bromo-2-[(4-methylphenyl)sulfonyl] acetamide (antfoggant) | 2.6 |
| Naphthyl triazine (print-up stabilizer) | 0.6 |
| Palmitic acid (10% by weight in 10.5% by weight MEK solution of Butvar B-76)(antifoggant) | 31.1 |
| N (4-hydroxyphenyl)benzenesulfonamide (12% by weight in 10.5% by weight MEK/Methane (50:50) solution of Butvar B-76) (developing agent) containing 0.74% Trimethyl Borate (crosslinking agent) | 513.8 |
| Butvar B-76 (18.3% by weight in MEK/Toluene/Methanol 77:12:11) (binder) | 43.1 |
| Copper(II) 2,9,16,23-tetra-tert-butyl-29H,31H-phthalocyanine I-2 (0.25% by weight in toluene) (acutance dye) | 10.8 |

The resulting photothermographic solution silver halide composition was coated at a wet laydown of 79.6 grams/m2 on the poly ethylene terephthalate film support from example 7. The coating was permitted to dry and was then overcoated with the following composition:

| Component | Grams |
|---|---|
| Distilled Water | 234.3 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Methylmethacrylate matte (2.5 micron) (24.5 by weight in a 1% gelatin in water solution) (matting agent) | 1.2 |
| Acid Blue 93 II-2 (1% in water) (tinting dye) | 8.0 |
| Basilen Violet F-5R (1% in water) (tinting dye) | 100.0 |

The resulting overcoat formulation was coated at a wet laydown of 40.4 grams/m2. The coating was permitted to dry. Then the pelloid side was coated with the following composition:

| Component | Grams |
|---|---|
| Distilled Water | 342.2 |
| Polyvinyl Alcohol (PVA) (6.4% by weight in distilled water) (binder) | 250.5 |
| Tetraethyl Orthosilicate (35.4% by weight in methanol/water (53:47)) (hardener) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Styrene-divinylbenzene (50/50) matte (5.0 micron) (24.5 by weight in a 1% gelatin in water solution) (matting agent) | 1.2 |

The resulting photothermographic element was exposed using a 683 nm laser and processed at 124° C. for 5 sec to provide images.

EXAMPLE 12

A polyester dye pellet concentrate was made as in example 3 above, except that in addition to the dye of structure I at 0.4 wt % concentration, dye III-11 was added to the polyester at a level of 0.2 wt %. The desired casting conditions were established on a biaxial film line to produce biaxially oriented films nominally 178 microns in thickness with a combined stretch ratio of from 9.0 to 16.0, most preferably from 11.5 to 14.0. Once a stable film was established with unblended polyester, the dye concentrate from above was added to the feed stream from a secondary feed hopper at a rate sufficient to achieve a final dye loading of 50 to 800 ppm. This procedure yielded uniform, biaxially oriented films once the transition from clear to dyed support was complete. The colorspace of this support is described in Table 1.

EXAMPLE 13

The following components were mixed to form an emulsion (A):

| Component | Grams |
|---|---|
| Silver Behenate dispersion (contains 28.0% by weight silver behenate in 7.0% by weight methyl ethyl ketone (MEK)/toluene (80:20) solution of polyvinylbutyral (Butvar B-76 which is a trademark of and available from the Monsanto Co., U.S.A)) (organic silver salt oxidizing agent) | 877.0 |
| Silver bromide (silver bromide emulsion contains 42.03 g Ag in 8.6% by weight MEK solution of Butvar B-76) containing sodium Iodide (NaI) (0.1% by weight) (speed increasing addendum) | 163.3 |
| Sensitizing dye (0.17% by weight solution in MEK/2-ethoxy ethanol (90:10)) | 76.3 |
| Succinimide (toner) | 4.7 |
| Phthalimide (toner) | 9.3 |
| SF-96 (10% by weight SF-96 in MEK. SF-96 is a silicone and is a tradename of General Electric Co., U.S.A.) (surfactant) | 1.6 |
| 2-Bromo-2-[(4-methylphenyl)sulfonyl] acetamide (antfoggant) | 2.6 |
| Naphthyl triazine (print-up stabilizer) | 0.6 |
| Palmitic acid (10% by weight in 10.5% by weight MEK solution of Butvar B-76)(antifoggant) | 31.1 |
| N (4-hydroxyphenyl)benzenesulfonamide (12% by weight in 10.5% by weight MEK/Methanol (50:50) solution of Butvar B-76) (developing agent) containing 0.74% Trimethyl Borate (crosslinking agent) | 513.8 |
| Butvar B-76 (18.3% by weight in MEK/Toluene/Methanol 77:12:11) (binder) | 43.1 |
| Copper(II) 2,9,16,23-tetra-tert-butyl-29H,31H-phthalocyanine I-2 (0.25% by weight in toluene) (acutance dye) | 10.8 |

The resulting photothermographic solution silver halide composition was coated at a wet laydown of 79.6 grams/$m^2$ on the polyethylene terephthalate film support from example 7. The coating was permitted to dry and was then overcoated with the following composition:

| Component | Grams |
|---|---|
| Distilled Water | 342.3 |
| Polyvinyl Alcohol (PVA) (6.4% by weight in distilled water) (binder) | 250.5 |
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Methylmethacrylate matte (2.5 micron) (24.5 by weight in a 1% gelatin in water solution) (matting agent) | 1.2 |

The resulting overcoat formulation was coated at a wet laydown of 40.4 grams/$m^2$. The coating was permitted to dry. Then the pelloid side was coated with the following composition:

| Component | Grams |
|---|---|
| Distilled Water | 342.2 |
| Polyvinyl Alcohol (PVA) (6.4% by weight in distilled water) (binder) | 250.5 |

-continued

| Component | Grams |
|---|---|
| Tetraethyl Orthosilicate (35.4% by weight in methanol/water (53:47)) (hardner) | 146.9 |
| p-Toluene Sulfonic Acid | 0.3 |
| Lodyne S-100 (7.75% by weight in water) (surfactant) | 0.2 |
| Olin 10G (10% by weight in distilled water. Olin 10G is para-isononylphenoxy polyglycidol and is a trademark of and available from the Olin Corp., U.S.A.) (surfactant) | 6.0 |
| Styrene-divinylbenzene (50/50) matte (5.0 micron) (24.5 by weight in a 1% gelatin in water solution) (matting agent) | 1.2 |

The resulting photothermographic element was exposed using a 683 nm laser and processed at 124° C. for 5 sec to provide images.

Evaluation of Image Tone

Samples of films from the above examples were exposed using a 685 nm 50 mw laser and processed at temperatures ranging from 110° C. to 130° C. for 1–20 sec to produce a developed silver image. The developed silver image had a maximum density of 3.5 with a relative Log E speed of 1.00 measured at a density of 1.0 above $D_{min}$. The comparative film was Example 13. The films were viewed on a standard lightbox and the image tone was evaluated subjectively using the following scale:

1—unacceptable image tone
2—marginal image tone
3—good, acceptable image tone
4—excellent image tone

TABLE 1

| Example | Tinting Dye(s) | Laydown mg/m$^2$ | Hue Angle(s) of dyes used | Hue Angle for Processed Film | Image Tone Evaluation |
|---|---|---|---|---|---|
| 8 | III-11 | 17.65 | 303 | 223 | 3 |
| | II-2 | 0.43 | 254 | | |
| 9 | Basilen Violet F-5R* II-2 | 91.49 | 305 | 234 | 4 |
| | | 3.23 | 254 | | |
| 10 | V-13 | 8.61 | 317 | 233 | 4 |
| 11 | Basilen Violet F-5R* II-2 | 91.49 | 305 | 234 | 4 |
| | | 3.23 | 254 | | |
| 12 | III-11 | 26.91 | 302 | 227 | 3 |
| 13 | — | — | 204 | 175 | 1 |

*Basilen Violet F-5R is a proprietary dye of the BASF Corporation.

The invention has been described in detail with particular reference to certain preferred embodiments thereof, but it will be understood that variations and modifications can be effected within the spirit and scope of the invention.

What is claimed is:

1. A photothermographic element comprising:

(a) a support bearing on one surface thereof (b) a photosensitive emulsion layer comprising:

(i) a binder;

(ii) a light-insensitive organic silver salt, (iii) a reducing agent, and (iv) a photosensitive silver halide emulsion;

(c) an antihalation dye; and (d) one or more tinting dyes such that the final color space of the element lies within the range defined by $220° < h_{ab} < 260°$, where $h_{ab}$ is the psychometric hue angle, $h_{ab} = \arctan(b^*/a^*)$, as defined in the CIELAB color system, wherein the antihalation dye is of structure I:

(I)

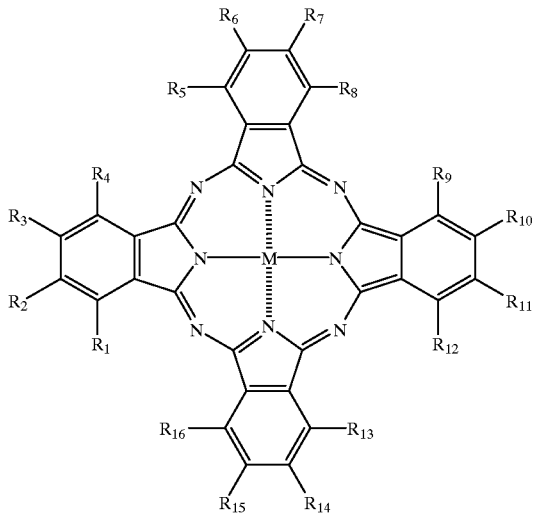

wherein:

$R_1$, $R_4$, $R_5$, $R_8$, $R_9$, $R_{12}$, $R_{13}$, $R_{16}$ independently represent hydrogen, or substituted or unsubstituted, branched or unbranched alkyl of 1–10 carbons atoms;

$R_2$, $R_3$, $R_6$, $R_7$, $R_{10}$, $R_{11}$, $R_{14}$, $R_{15}$ independently represent hydrogen, substituted or unsubstituted, branched or unbranched alkyl of 1–10 carbon atoms, substituted or unsubstituted aryl, halogen, substituted or unsubstituted alkoxyl of 1–10 carbons, substituted or unsubstituted aryloxy;

or $R_1$ and $R_2$, $R_2$ and $R_3$, $R_3$ and $R_4$, $R_5$ and $R_6$, $R_6$ and $R_7$, $R_7$ and $R_8$, $R_9$ and $R_{10}$, $R_{10}$ and $R_{11}$, $R_{11}$ and $R_{12}$, $R_{13}$ and $R_{14}$, $R_{14}$ and $R_{15}$ and/or $R_{15}$ and $R_{16}$ taken together may represent the atoms necessary to form a substituted or unsubstituted 6 membered aromatic or heteroaromatic ring; and M is a multi-valent metal selected from: Mg, Ca, Sr, Ti, V, Cr, Mn, Fe, Co, Ni, Cu, Zn, B, Al, Sn, Pb, Mo, Pd and Pt.

2. An element according to claim 1, wherein M is Mg, Ni, Zn, or Cu.

3. An element according to claim 1, wherein each of $R_1$ and $R_4$ is H.

4. An element according to claim 3, wherein each of $R_2$ and $R_3$ is alkyl of 1–10 carbon atoms.

5. An element according to claim 4, wherein each of $R_2$ an $R_3$ is t-butyl.

6. An element according to claim 1, wherein the tinting dye is of formula II:

(II)

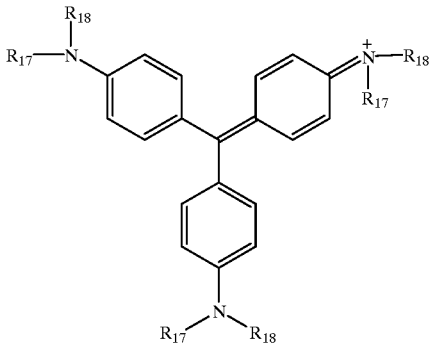

wherein $R_{17}$ and $R_{18}$ are independently hydrogen, substituted or unsubstituted alkyl, substituted or unsubstituted cycloalkyl, or substituted or unsubstituted aryl.

7. An element according to claim 6, wherein the tinting dye is:

II-1

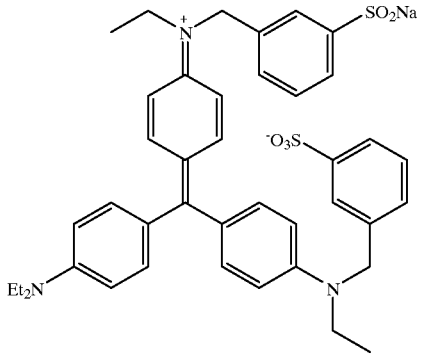

II-2

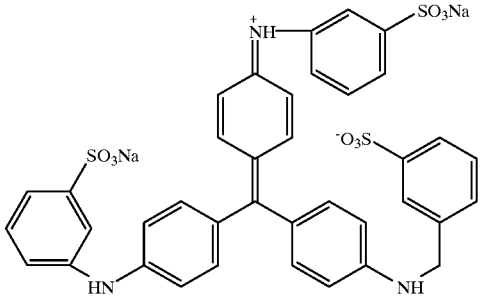

II-3

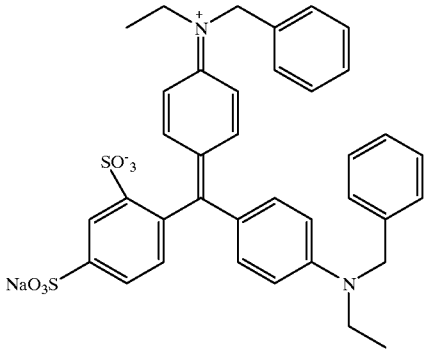

-continued

II-4

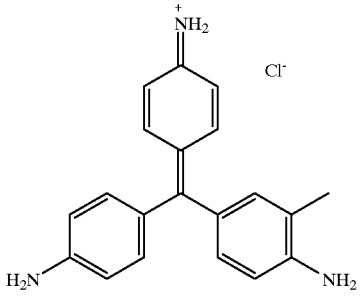

II-5

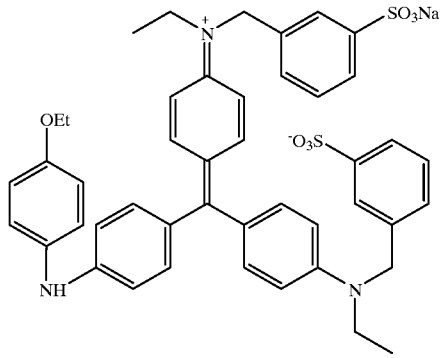

II-6

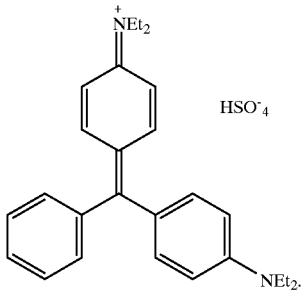

8. An element according to claim 1, wherein a tinting dye is of formula III:

(III)

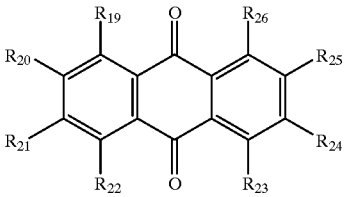

wherein $R_{19}$ through $R_{26}$ independently represent a hydrogen atom, a hydroxyl group, a substituted or unsubstituted alkoxyl group, a substituted or unsubstituted aryloxy group, or a substituted or unsubstituted amino group.

9. An element according to claim 8, wherein the tinting dye is:

III-1
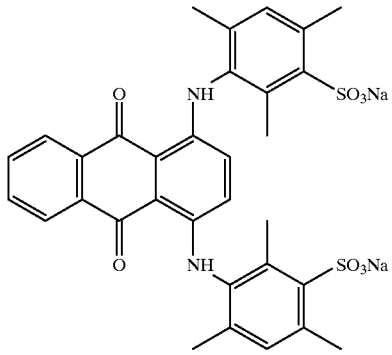
III-2
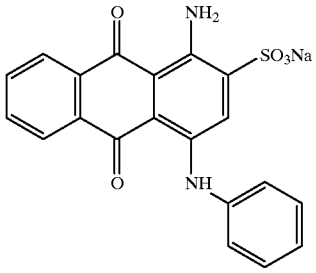
III-3
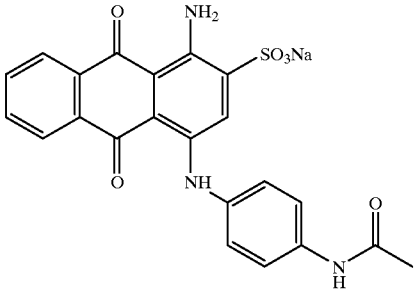
III-4
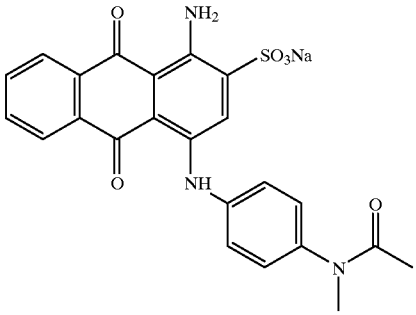
III-5
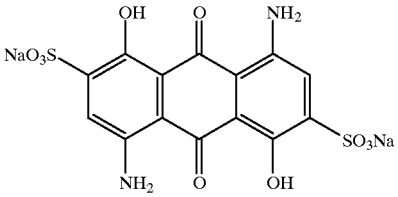
-continued
III-6
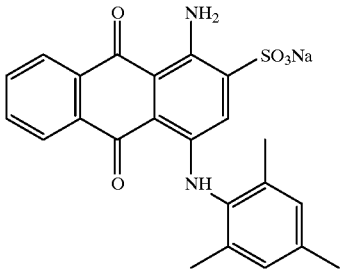
III-7
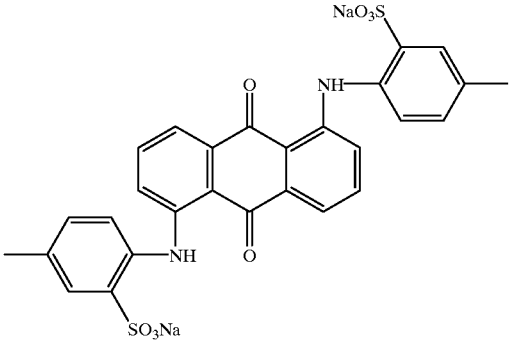
III-8
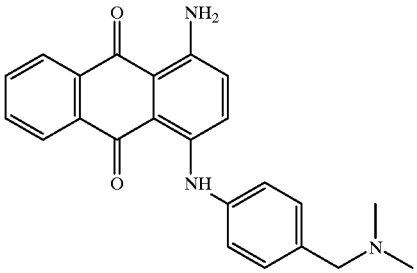
III-9
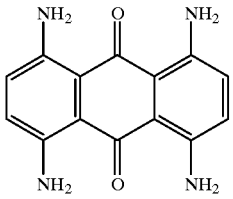
III-10
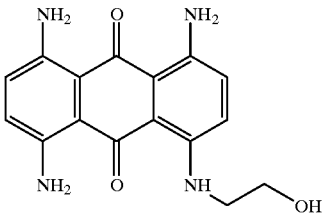
or -continued

III-11

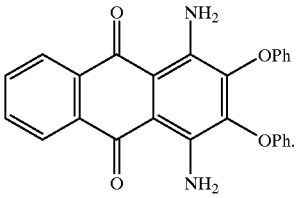

10. An element according to claim 1, wherein the tinting dye is of formula (IVa) or (IVb):

(IVa)

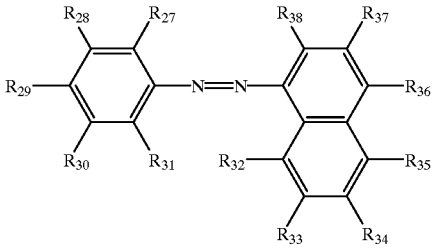

or

-continued (IVb)

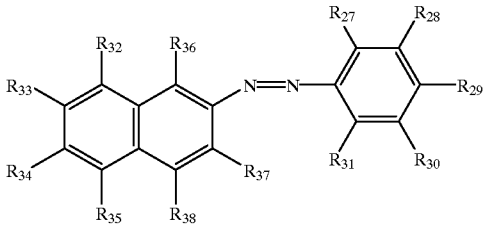

wherein $R_{27}$ through $R_{38}$ independently represent a hydrogen atom, a hydroxyl group, a substituted or unsubstituted amino group, a sulfonate group, a nitro group, a substituted or unsubstituted alkoxyl group, a substituted or unsubstituted alkyl group, an aromatic substituted diazo group, or a divalent group capable of forming a bond with a metal atom to provide a metal-complexed dye.

11. An element according to claim 10, wherein the tinting dye is:

IV-1

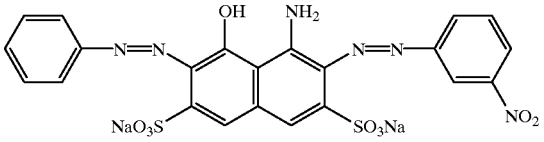

IV-2

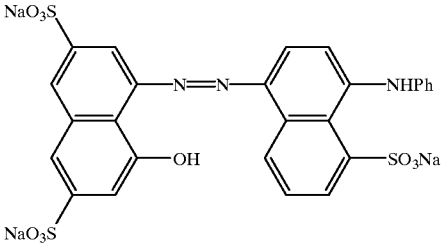

IV-3

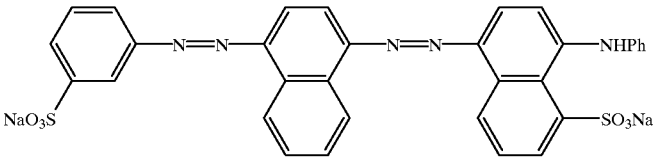

IV-4

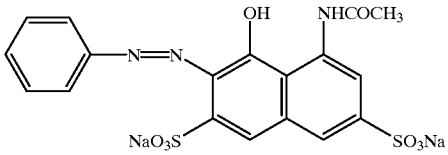

IV-5

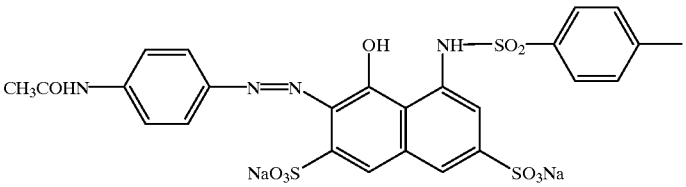

-continued

IV-6

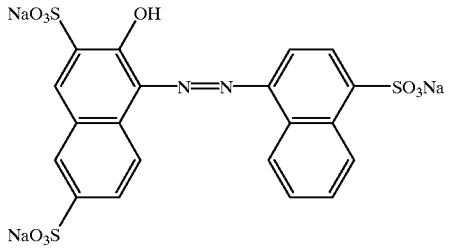

IV-7

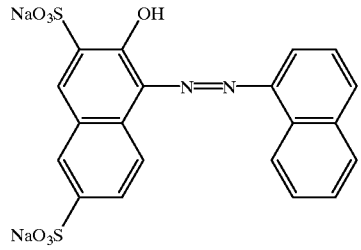

IV-8

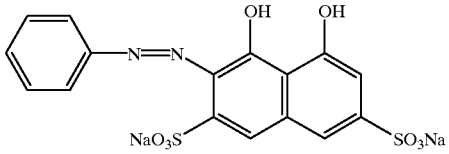

IV-9

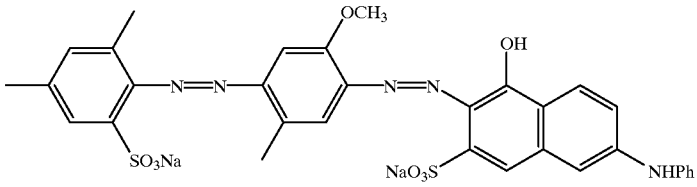

IV-10

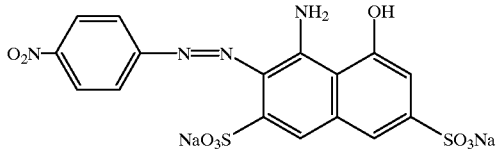

IV-11

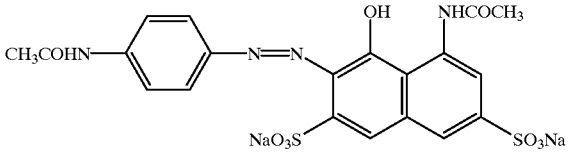

IV-12

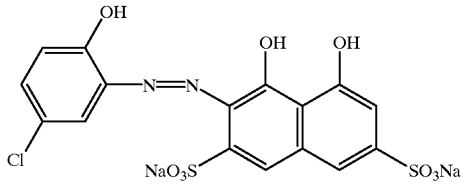

IV-13

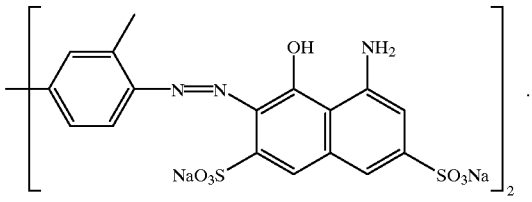

12. An element according to claim 1, wherein the tinting dye is of formula V:

(V)

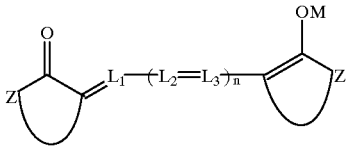

wherein

Z comprises the atoms necessary to complete a cyclic or heterocyclic ring system; $L_1$,$L_2$, and $L_3$ are substituted or unsubstituted methine groups, and n=0–2; and M is a hydrogen atom, trialkylammonium group, or a cationic, monovalent metal.

13. An element acording to claim 12, wherein the tinting dye is:

V-1
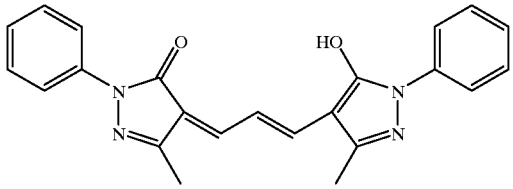
V-2
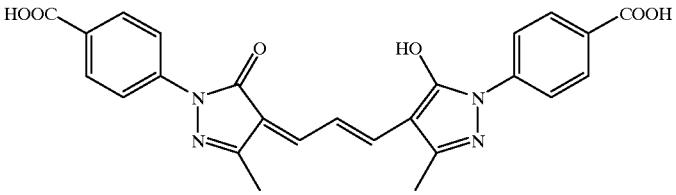
V-3
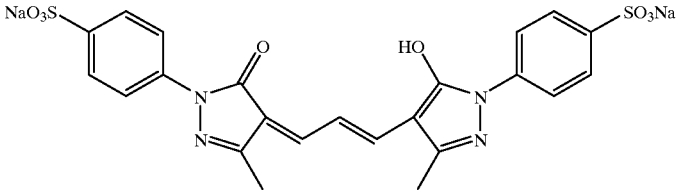
V-4
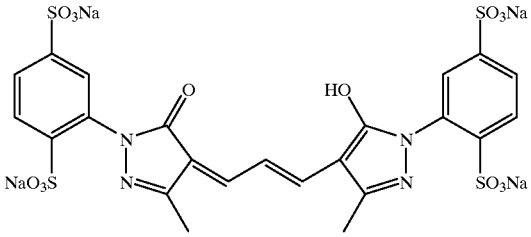
V-5
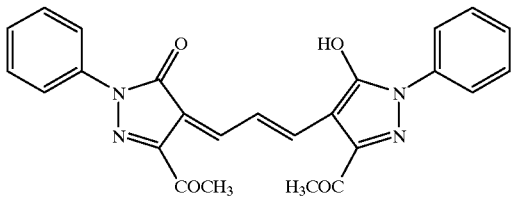
V-6
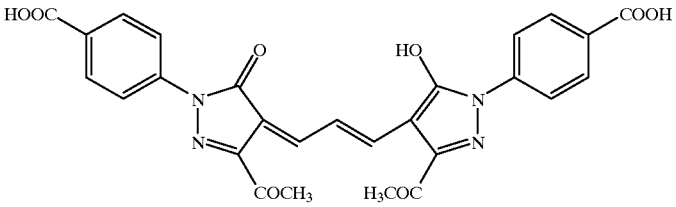
V-7
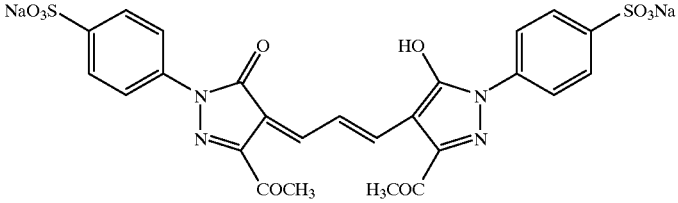

-continued
V-8
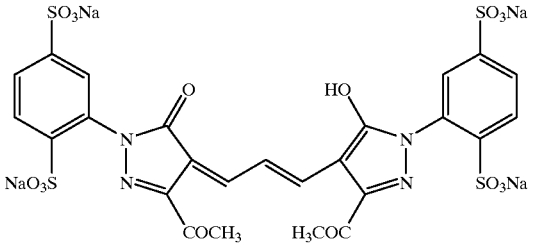
V-9
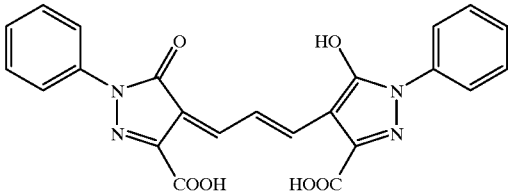
V-10
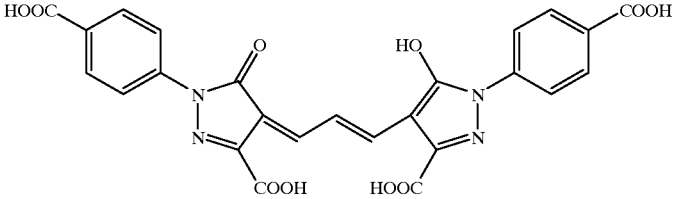
V-11
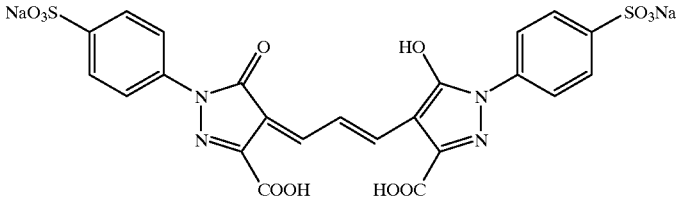
V-12
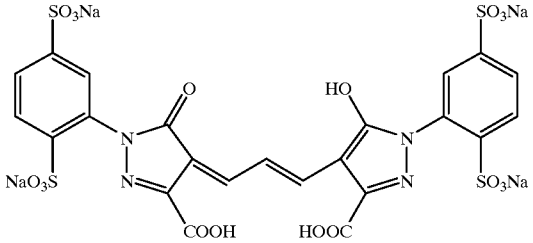
V-13
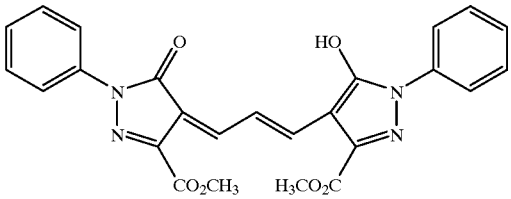
V-14
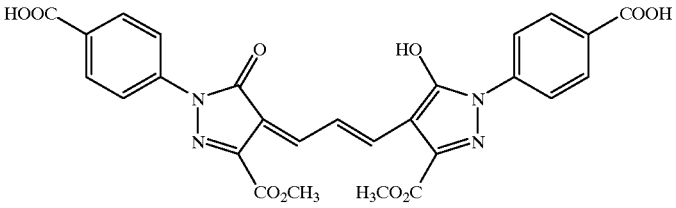

-continued
V-15
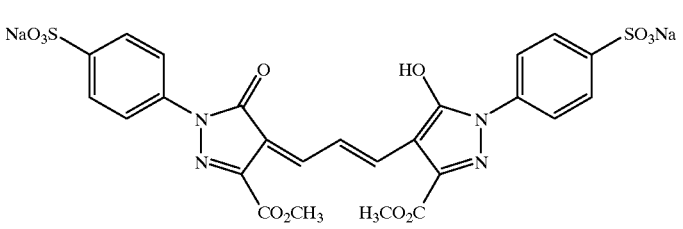
V-16
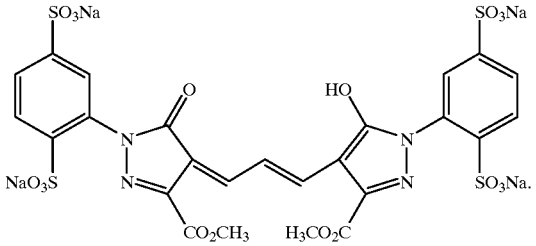
14. An element according to claim 1, wherein the anti-halation dye is in the support.
15. An element according to claim 14, wherein the tinting dye is in the support.
16. An element according to claim 14, further comprising an overcoat layer and the tinting dye is in the overcoat layer.
* * * * *

UNITED STATES PATENT AND TRADEMARK OFFICE

CERTIFICATE OF CORRECTION

PATENT NO. : 6,174,657 B1
DATED : January 16, 2001
INVENTOR(S) : Charles H. Weidner et al.

It is certified that error appears in the above-identified patent and that said Letters Patent is hereby corrected as shown below:

Claim 7,
Structure II-1
Should be

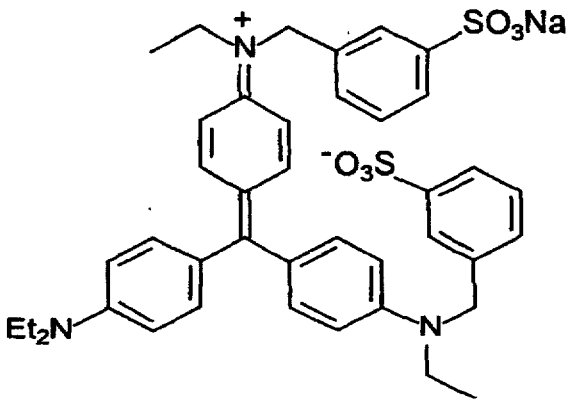

II-1

Claim 9,
Structure III-10
Should be

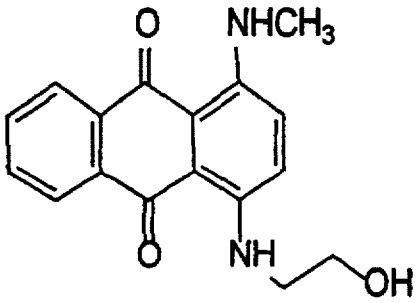

III-10

Signed and Sealed this

Fifth Day of February, 2002

*Attest:*

*Attesting Officer*

JAMES E. ROGAN
*Director of the United States Patent and Trademark Office*